US005604931A

United States Patent [19]

Rhoades

[11] Patent Number: 5,604,931

[45] Date of Patent: Feb. 25, 1997

[54] PROTECTIVE GLOVE

[76] Inventor: Harvey I. Rhoades, 300 Hal Muldrow Dr. #236, Norman, Okla. 73069

[21] Appl. No.: 4,475

[22] Filed: Jan. 19, 1993

Related U.S. Application Data

[63] Continuation of Ser. No. 952,198, Sep. 28, 1992, abandoned, which is a continuation of Ser. No. 673,713, Mar. 22, 1991, abandoned.

[51] Int. Cl.[6] ..... A41D 19/00

[52] U.S. Cl. ..... 2/16; 2/19; 2/161.1

[58] Field of Search ..... 2/16, 20, 19, 159, 2/160, 161.1, 162

[56] References Cited

U.S. PATENT DOCUMENTS

| | | | |
|---|---|---|---|
| Re. 32,566 | 12/1987 | Patton, Jr. | 2/161 A |
| D. 275,219 | 8/1984 | Scales, Jr. | D21/234 |
| 1,577,540 | 3/1926 | Punches | 2/16 |
| 2,394,136 | 2/1946 | Bakke | 2/16 X |
| 3,149,839 | 9/1964 | Materia | 2/161 A |
| 3,228,035 | 1/1966 | Davis | 2/161 A |
| 3,871,029 | 3/1975 | Hollman | 2/161 A |
| 4,011,596 | 3/1977 | Chang | 2/16 |
| 4,042,975 | 8/1977 | Elliott, Jr. et al. | 2/19 |
| 4,084,265 | 4/1978 | Anfelt | 2/163 |
| 4,137,572 | 2/1979 | Jansson et al. | 2/16 |
| 4,183,098 | 1/1980 | Knowles, Jr. | 2/16 |
| 4,193,135 | 3/1980 | Rhee | 2/162 |
| 4,374,439 | 2/1983 | Norman | 2/161 A |
| 4,400,829 | 8/1983 | Willis | 2/16 |
| 4,411,024 | 10/1983 | Hayes | 2/20 |
| 4,497,073 | 2/1985 | Deutsch | 2/16 X |
| 4,561,122 | 12/1985 | Stanley et al. | 2/20 |
| 4,624,016 | 11/1986 | Luevano | 2/161 A |
| 4,748,690 | 6/1988 | Webster | 2/19 |
| 4,809,366 | 3/1989 | Pratt | 2/170 |
| 5,150,475 | 9/1992 | Hansen et al. | 2/170 X |

*Primary Examiner*—Michael A. Neas
*Attorney, Agent, or Firm*—Dunlap & Codding, P.C.

[57] ABSTRACT

A protective glove adapted to be fitted over an individual's hand area and wrist area. The protective glove includes a hand cover constructed of a flexible material adapted to cover and surround the hand area of the individual and a hand protector. The hand protector includes at least a portion constructed of a rigid material capable of being hit with a hard thrown baseball without substantially bending or breaking. The hand protector is connected to the hand cover and positioned on the hand cover whereby the hand protector is positioned over carpals in the hand. The protective glove also includes a wrist protector having at least a portion constructed of a rigid material capable of being hit with a hard thrown baseball without substantially bending or breaking. The wrist protector is connected to the hand cover and positioned on the hand cover whereby the wrist protector is positioned over a portion of the ulna in the wrist area.

12 Claims, 4 Drawing Sheets

PROTECTIVE GLOVE

This is a continuation of application Ser. No. 07/952,198 filed on Sep. 28, 1992, entitled "PROTECTIVE GLOVE" now abandoned, which is a continuation of application Ser. No. 673,713 filed on Mar. 22, 1991, entitled "PROTECTIVE GLOVE" now abandoned.

FIELD OF THE INVENTION

The present invention relates to a protective glove having a hand protector covering and protecting the carpals in the hand and a wrist protector covering and protecting a portion of the ulna in the wrist area. The protective glove may include either the hand protector or the wrist protector or both.

DESCRIPTION OF THE PREFERRED EMBODIMENTS

Figure 1:
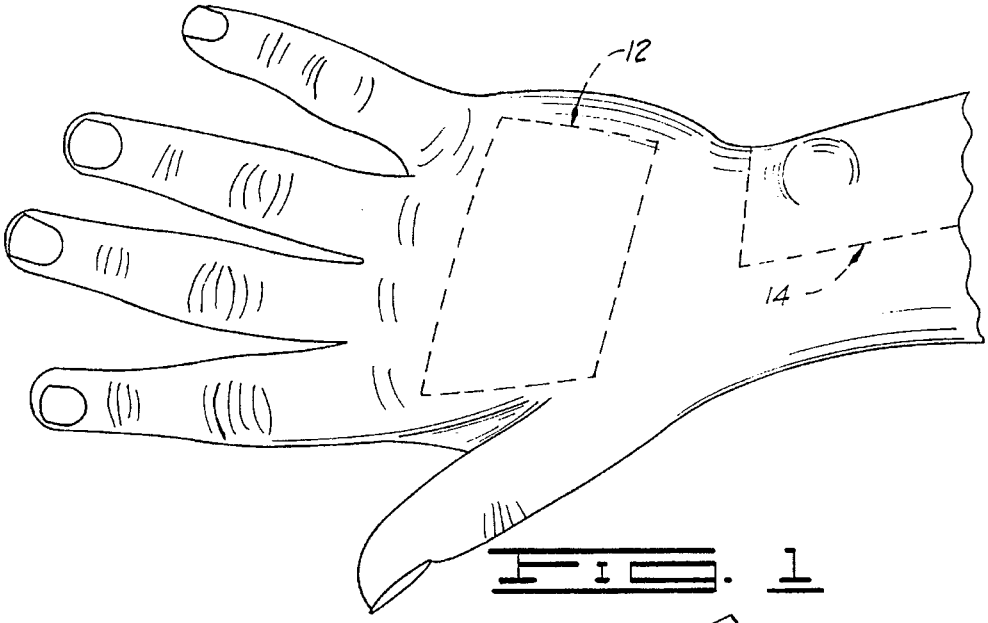
FIG. 1 is a diagrammatic view showing the anterior (top) of an individual's right hand and wrist area.

Shown in FIGS. 2, 3, 4 and 5 and designated by the general reference numeral 10 is a protective batting glove constructed in accordance with the present invention. In playing baseball and particularly when batting, the individual's or batter's hand and wrist area are exposed to injury as a result of being hit with a relatively hard thrown baseball. More particularly, when batting, an individual's hand area 12 (FIG. 1) and wrist area 14 (FIG. 1) are exposed to injury as a result of being hit by a relatively hard thrown baseball.

The term "hand area" as used herein when referring to the hand area 12 means the anterior of an individual's hand extending from about the left to about the right side of the anterior of the individual's hand and extending from about the knuckles to about the wrist of the individual's hand and particularly includes the area encompassing the carpals in the individual's hand.

The term "wrist area" as used herein in referring to the wrist area 14 means an area extending from about the end of the radius or ulna back toward the elbow a distance about three to about six inches, and, more particularly, the term "wrist area" is used herein includes an area extending from about the end of the ulna (ulna, styloid) back toward the elbow a distance of about three to about six inches on the outside of the individual's wrist.

The protective glove 10 of the present invention is adapted to provide protection substantially reducing the possibility of injury to the individual's carpals and the portion of the individual's ulna in the wrist area 14.

Figure 2:
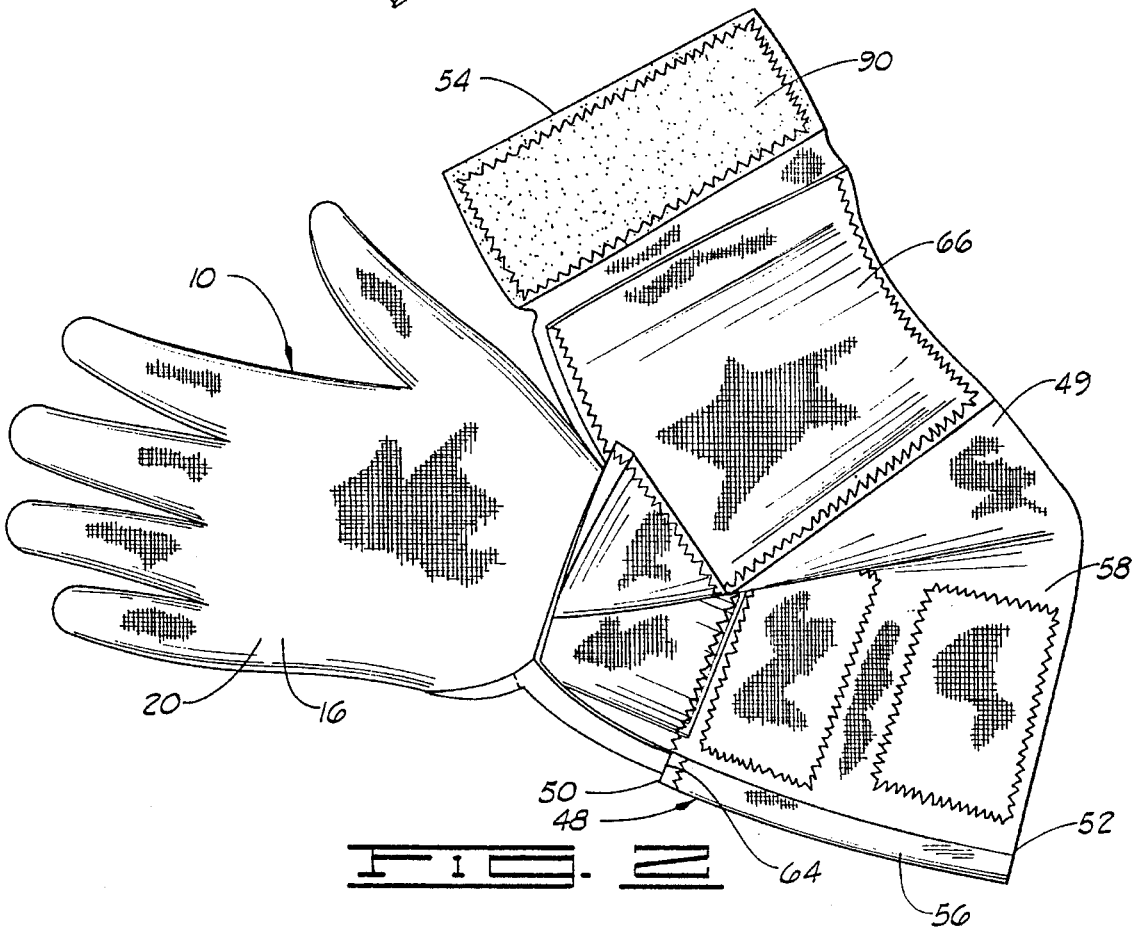
FIG. 2 is a posterior or bottom view of a protective glove constructed in accordance with the present invention showing the wrist protector in an opened position.
Figure 3:
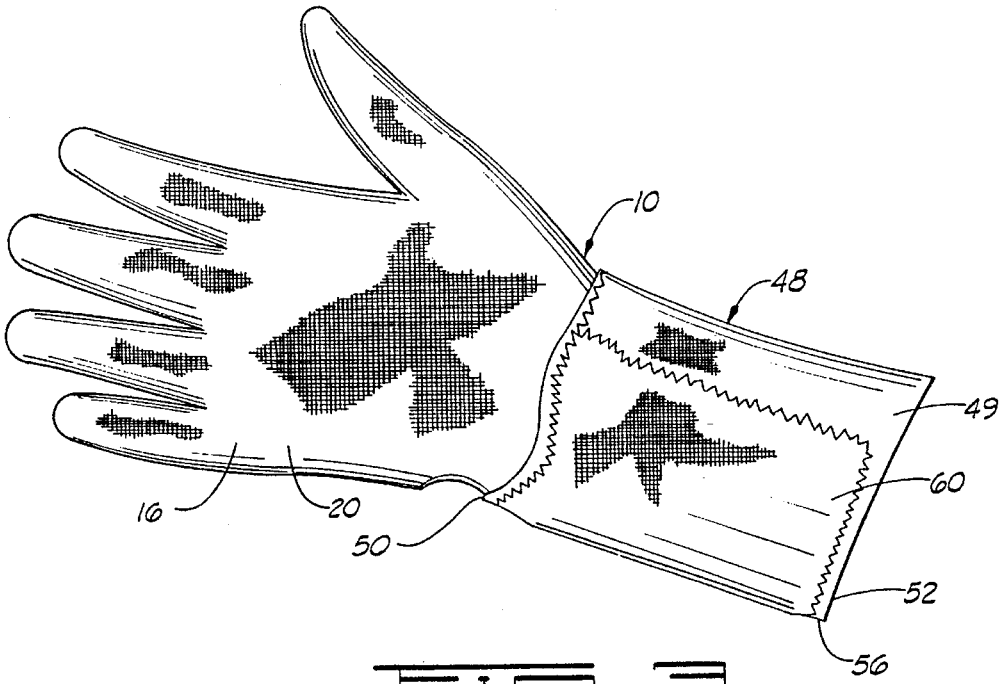
FIG. 3 is a top elevational view of the protective glove similar to FIG. 2, but showing the wrist protector in a closed position.
Figure 4:
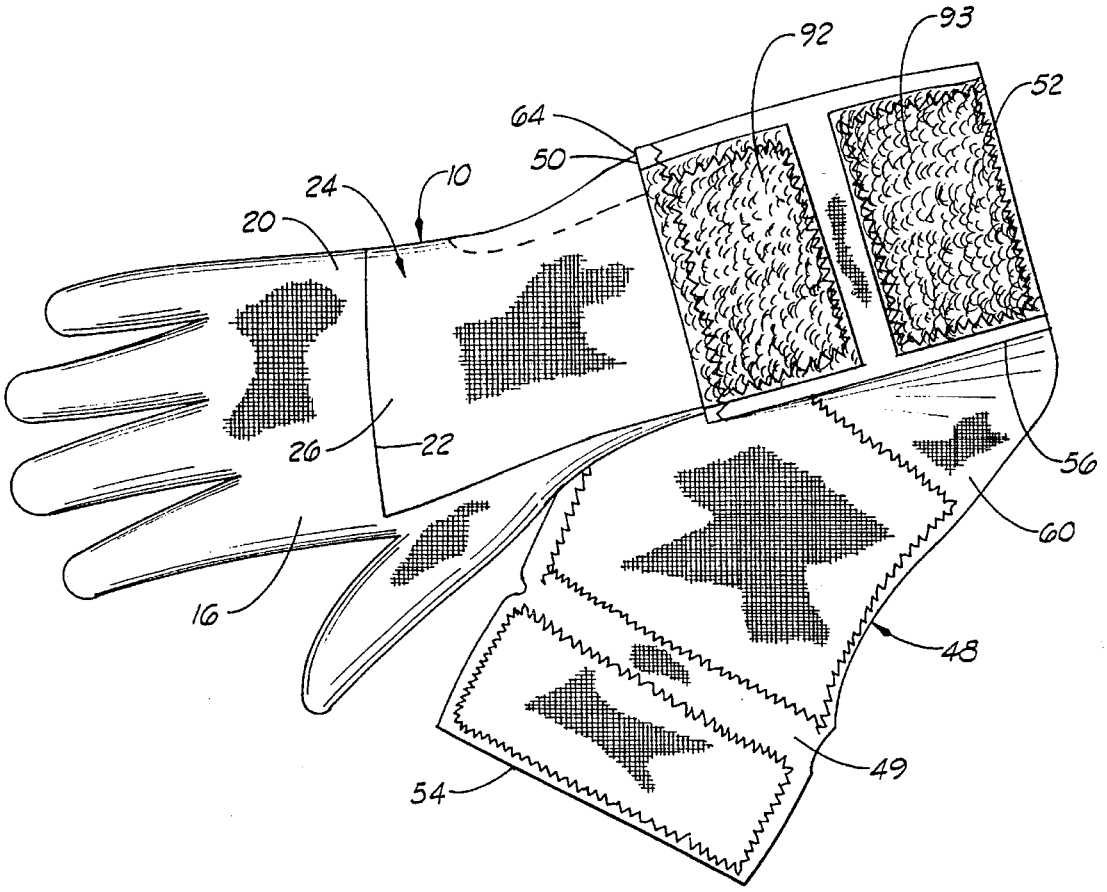
FIG. 4 is an anterior or top elevational view of a protective glove showing the wrist protector in the opened position.
Figure 5:
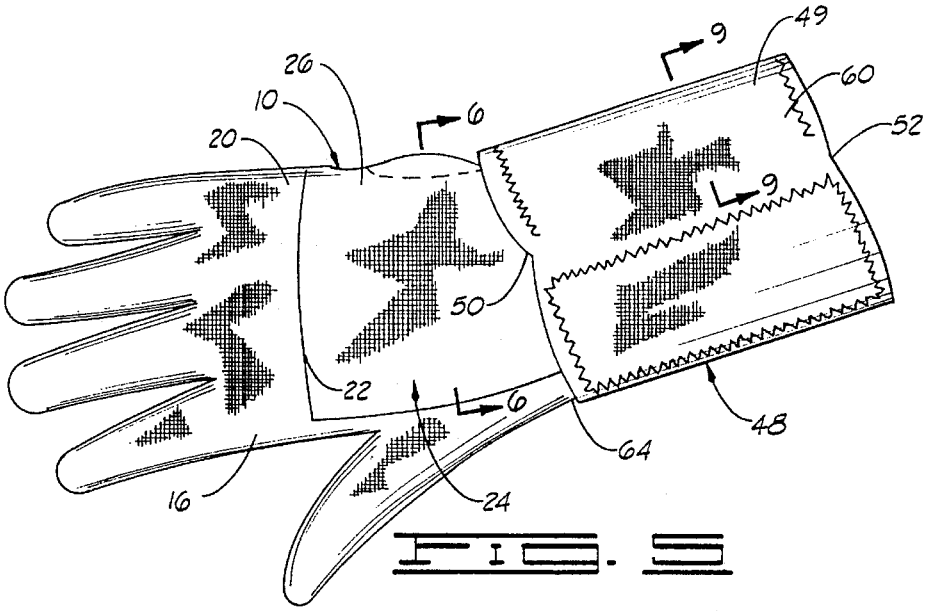
FIG. 5 is a view of the protective glove similar to FIG. 4, but showing the wrist protector in the closed position.

The protective glove 10 includes a hand cover 16 (FIGS. 2, 3, 4 and 5) which is constructed of a relatively flexible fabric (natural or synthetic) material. The hand cover 16 may be constructed of any material commonly utilized to make hand gloves for baseball. The hand cover 16 covers and surrounds the individual's hand and, in one preferred embodiment as shown in FIGS. 2 and 3, the hand cover 16 also includes portions extending over and covering the individual's fingers and thumb (phalanges). In particular, the hand cover 16 covers and surrounds the hand area 12 of the individual's hand.

The protective glove 10 includes a hand protector 18 (FIGS. 6, 7 and 8) having at least a portion constructed of a rigid material capable of being hit by a hard thrown baseball which is traveling at a relatively high velocity without substantially bending or breaking. In one preferred embodiment, the hand protector 18 includes a portion constructed of a relatively rigid metal such as a high density aluminum. The hand protector 18 is connected to the hand cover 16 and positioned on the hand cover 16 so that the hand protector 18 is positioned over the hand area 12 when the hand cover 16 is positioned on the individual's hand. The hand cover 18 more particularly is connected to the hand over 16 and extends over and substantially encompasses the carpals in the individual's hand area 12 flexibility of the wrist of the individual when batting the baseball.

The hand cover 16 also includes a base cover 20 (FIGS. 2-5) constructed of the flexible material commonly used in making baseball gloves. A portion of the base cover 20 generally encompassing the hand area 12 is cut out of the base cover 20 leaving an opening 22 (FIGS. 4 and 5) in the base cover 20. A protector assembly 24 (FIGS. 4, 5 and 6) is positioned in the opening 22 and connected by way of sewing to the base cover 20.

The protector assembly 24 comprises a front panel 26 (FIGS. 4, 5 and 6) constructed of an elastic material and a back panel 28 (FIG. 6) constructed of a flexible cloth material. The front panel 26 is connected to the back panel 28 generally along the edges of the front and the back panels 26 and 28 thereby leaving a pocket 30 (FIG. 6) disposed generally between the front and the back panels 26 and 28. One edge of the front and the back panels 26 and 28 is left unconnected thereby providing access to the pocket 30. The hand protector 18 is disposed in the pocket 30 and the front and the back panels 26 and 28 are connected together to secure the hand protector 18 within the pocket 30.

Figure 6:
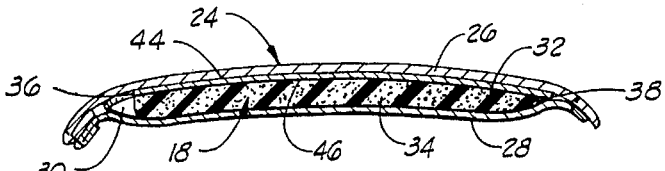
FIG. 6 is a sectional view taken substantially along the lines 6—6 of FIG. 5.
Figure 7:
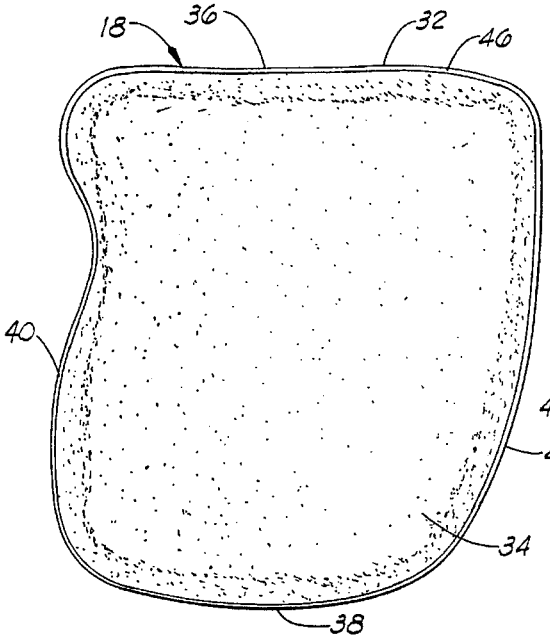
FIG. 7 is a bottom elevational view of the base and pad portion of the protector assembly of the hand protector.
Figure 8:
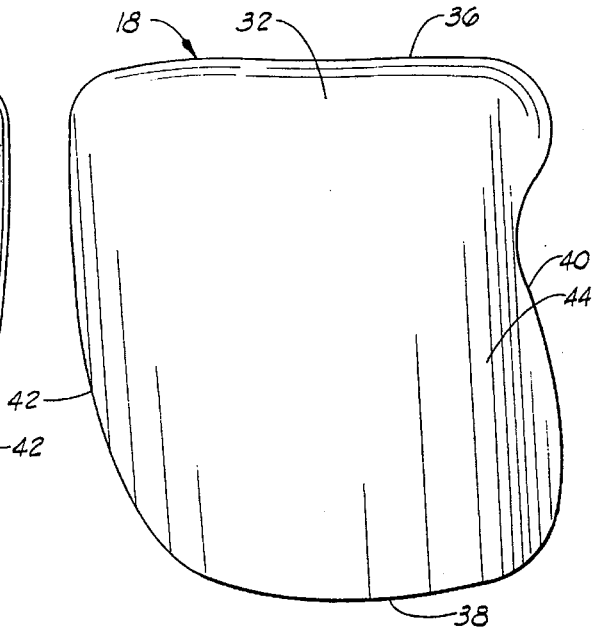
FIG. 8 is a top elevational view of the base and pad shown in FIGS. 6 and 7.

As shown more clearly in FIGS. 6, 7 and 8, the hand protector 18 more particularly comprises a base 32 (FIGS. 6, 7 and 8) and a pad 34 (FIG. 6 and 7). As shown in FIGS. 6, 7 and 8, the base 32 has an upper end 36, a lower end 38, a first side 40, a second side 42, an upper surface 44 and a lower surface 46. The base 32 is formed on a slight arc extending generally between the first and the second sides 40 and 42 substantially conform to the contour of the hand area 12. The base 32 is constructed of a rigid material capable of being hit by hard thrown baseball which is traveling at a relatively high velocity without substantially bending or breaking and, preferably, the base 32 is constructed of a metal such as a high density aluminum.

The pad 34 is constructed of a foam material such as a foam polyurethane. The pad 34 is connected to the lower surface 46 of the base 32. The pad 34 is capable of absorbing some of the shock when the hand protector 18 is hit by a relatively hard thrown baseball.

The hand protector 18 is positioned in the pocket 30 so that the pad 34 is positioned generally adjacent the individual's hand when the hand cover 16 is positioned on the individual's hand with the base 32 and pad 34 extending generally over and encompassing the hand area 12.

Figure 9:
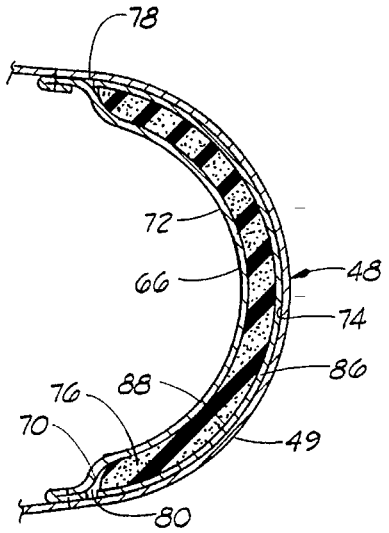
FIG. 9 is a sectional view taken substantially along the lines 9—9 of FIG. 5.
Figure 10:
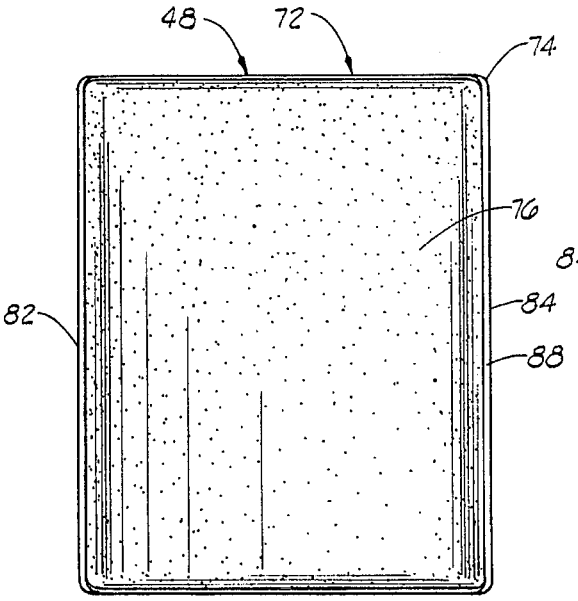
FIG. 10 is a bottom elevational view of the base and pad portion of the protector assembly of the wrist protector.
Figure 11:
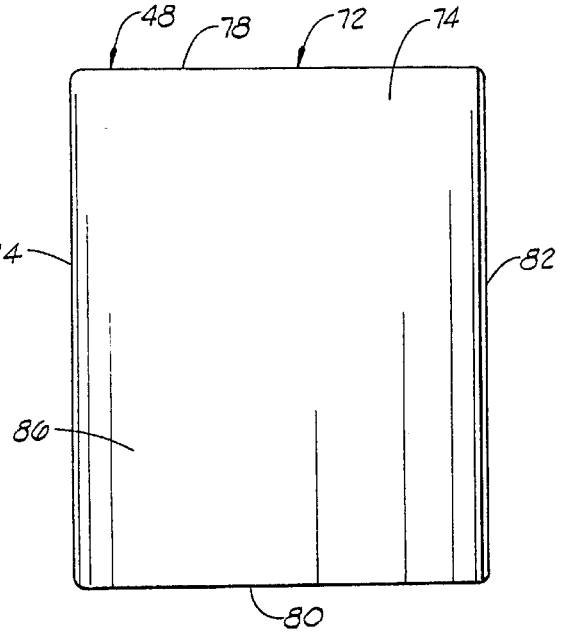
FIG. 11 is a top elevational view of the base and pad shown in FIGS. 9 and 10.

A wrist protector 48 (FIGS. 2, 3, 4 and 5) is connected to the hand protector 18. The wrist protector 48 is constructed preferably of an elastic, stretchable material. As shown in FIGS. 2–5, the wrist protector 48 includes a wrist band 49 having an upper end 50, a lower end 52, a first side 54, a second side 56, an inner surface 58, and an outer surface 60. A portion of the upper end 50 of the wrist band 49 is connected to a lower end 64 of the base cove 20 thereby securing the wrist band 49 to the base cover 20. The wrist band 49 is constructed of a stretchable elastic material. The wrist protector 48 is connected to the hand cover 16 and positioned on the hand cover 16 so that the wrist protector 48 extends over the ulna in the wrist area 14 when the hand cover 16 and the wrist protector 48 are positioned on the individual's hand so as not to impede the flexibility of the wrist of the individual when batting the baseball. A cloth panel 66 (FIGS. 2 and 9) is connected to a portion of the inner surface 58 of the wrist band 49. The edges of the cloth panel 66 more particularly are connected to the wrist band 49. In assembly, the three of the edges of the cloth panel 6 are connected to the wrist band 49 thereby leaving an opening which provides access to a pocket 70 (FIG. 9) formed between the cloth panel 66 and the wrist band 49. A protector assembly 72 (FIGS. 9, 10 and 11) is disposed through the opening and into the pocket 70. The opening then is closed by further connecting the edge of the cloth panel 66 to the wrist band 49 thereby securing the protector assembly 72 within the pocket 70. As shown in FIGS. 9, 10 and 11, the protector assembly 72 comprises a base 74 and a pad 76.

The base 74 is constructed of a rigid material capable of being hit by a hard thrown baseball without substantially bending or breaking. Preferably, the base 74 is constructed of a metal such as a high density aluminum. The base has an upper end 78, a lower end 80, a first side 82, a second side 84, an upper surface 86, and a lower surface 88. The base 74 is formed on an arc extending from the first side 82 to the second side 84.

The pad 76 is constructed of a foam material such as a foam polyethylene for example. The pad 76 is constructed of a material capable of absorbing some of the shock when the base 74 is hit by a baseball. The pad 76 is connected to the lower surface 88 of the base 74. The protector assembly 72 is positioned on the wrist band 49 such that the pad 76 is disposed generally adjacent the individual's arm in the wrist area 14 when the wrist protector 48 is connected to the individual's hand.

A Velcro® strip 90 (FIG. 2) is connected to the first side 54 of the wrist band 49. A pair of Velcro® strip 92 and 93 (FIG. 4) is connected to the second side 56 of the wrist band 49.

In operation, the individual places the hand cover 16 over the individual's hand and fingers in a position wherein the hand protector 18 is positioned generally over the carpals in the individual's hand with the pad 34 being positioned generally adjacent the individual's hand. In this position, a portion of the wrist band 49 is disposed generally adjacent the individual's hand in the wrist area 14. The individual then grasp the first side 54 of the wrist band 49 and pulls the wrist band 49 to a position wherein a portion of the first side 54 of the wrist band 49 is disposed generally over a portion of the second side 56 of the wrist band 44 with the Velcro®strip 92 and 93 being generally aligned with the Velcro® strip 90. The individual then presses the Velcro® strips 92 and 93 into engagement with the Velcro® strip 90. The Velcro®strips 90, 92 and 93 cooperate to secure the first side 54 of the wrist band 49 to the second side 56 of the wrist band 49 thereby securing the wrist band 49 in an assembled position extending generally about the individual's wrist and over the wrist area 14.

The wrist band 49 can be a single cylinderically shaped band constructed of a stretchable material. In this embodiment, the wrist band 49 is stretched and then pulled over the individual's wrist area, thereby eliminating the need for the Velcro® strips 90, 92 and 93.

In one embodiment, the wrist protector 48 is not connected to the hand protector 18. In this embodiment, the hand protector 18 can be used alone or the wrist protector 48 can be used alone or the hand protector 18 and the wrist protector 48 each can be used in the manner and for the reasons described before.

Changes may be made in the construction and the operation of the various components, elements and assemblies described herein without departing from the spirit and scope of the invention as defined in the following claims.

What is claimed is:

1. A protective batting glove adapted to be secured about an individual's hand and wrist when batting a baseball to protect a hand area and a wrist area of the individual from injury if hit thereon by the baseball, the protective glove comprising:

a flexible hand cover positionable about the hand of the individual so as to substantially cover the hand, the hand cover having a lower end;

hand protector means for protecting the hand area of the individual from injury when hit on the hand area with the baseball when batting the baseball, the hand protector means secured to the hand cover so that the hand protector means is positioned over the hand area of the individual when the hand cover is disposed about the hand of the individual; and wrist protector means secured to the lower end of the hand cover for protecting the wrist area of the individual from injury when hit on the wrist area with the baseball when batting the baseball;

wherein the hand protector means and the wrist protector means are secured to the hand cover so as not to impede the flexibility of the wrist of the individual when batting the baseball the hand protector means comprises:

a base constructed of a rigid metal material capable of being hit with the baseball when same is traveling at a relatively high velocity without substantially bending or breaking, the base having an upper surface and a lower surface; and pad means connected to the lower surface of the base for absorbing a portion of a shock when the base is hit with the baseball.

2. The protective glove of claim 1 wherein the base is arc shaped so as to substantially conform to the contour of the hand area.

3. The protective glove of claim 1 wherein the hand cover comprises:

a flexible base cover having an opening formed there through, the opening extending generally over the hand area when the hand cover is disposed over the hand of the individual; and wherein the hand protector means is disposed in the opening of the base cover and connected to the base cover.

4. The protective glove of claim 3 wherein the hand protector means further comprises:

a front panel; and a back panel, the back panel being connected to the front panel so as form a pocket generally between the front panel and the back panel, the front and the back panels each being disposed in the opening in the base cover and the front and the back panels each being connected to the base cover, the base and the pad means of the hand protector means being disposed generally within the pocket.

5.The protective glove of claim 4 wherein the hand protector comprises:

a base constructed of the rigid material capable of being hit with the hard thrown baseball without substantially bending or breaking; and a pad constructed of a flexible material connected to the base, the pad being positioned about adjacent the hand area when the hand cover is connected to the individual's hand and the pad being capable of absorbing a portion of the shock when the base is hit with the hard thrown baseball.

6. A protective batting glove adapted to be secured about an individual's hand and wrist when batting a baseball to protect a hand area and a wrist area of the individual from injury if hit thereon by the baseball, the protective glove comprising:

a flexible hand cover positionable about the hand of the individual so as to substantially cover the hand, the hand cover having a lower end;

hand protector means for protecting the hand area of the individual from injury when hit on the hand area with the baseball when batting the baseball, the hand protector means secured to the hand cover so that the hand protector means is positioned over the hand area of the individual when the hand cover is disposed about the hand of the individual, the hand protector means comprising, a base constructed of a rigid material capable of being hit with the baseball when same is traveling at a relatively high velocity without substantially bending or breaking, the base having an upper surface and a lower surface; and pad means connected to the lower surface of the base for absorbing a portion of a shock when the base is hit with the baseball; and wrist protector means for protecting the wrist area of the individual from injury when hit on the wrist area with the baseball when batting the baseball, the wrist protector means comprising:

a flexible wrist band connected to the lower end of the hand cover; and protector means secured to the wrist band so that the protector means is positioned over the wrist area of the individual when the wrist protector means is secured over the wrist of the individual for protecting the wrist area from injury when hit on the wrist area with the baseball, the protector means comprising:

a base constructed of a rigid material capable of being hit with the baseball when same is traveling at a relatively high velocity without substantially bending or breaking, the base having an upper surface and a lower surface; and pad means connected to the lower surface of the base for absorbing a portion of a shock when the base is hit with the baseball;

wherein the hand protector means and the wrist protector means are secured to the hand cover so as not to impede the flexibility of the wrist of the individual when batting the baseball.

7. The protective glove of claim 6 wherein the wrist band has an upper end, a lower end, a first side, a second side, an inner surface and an outer surface, wherein the upper end of the wrist band is connected to the lower end of the hand cover, and wherein the wrist protector means further comprises:

fastening means for fastening the first side of the wrist band to the second side of the wrist band so that the wrist band is secured generally over the wrist area of the individual.

8. A protective batting glove adapted to be secured about an individual's hand and wrist when batting a baseball to protect a hand area and a wrist area of the individual from injury if hit thereon by the baseball, the protective glove comprising:

a flexible hand cover positionable about the hand of the individual so as to substantially cover the hand, the hand cover having a lower end;

hand protector means for protecting the hand area of the individual from injury when hit on the hand area with the baseball when batting the baseball, the hand protector means secured to the hand cover so that the hand protector means is positioned over the hand area of the individual when the hand cover is disposed about the hand of the individual; and wrist protector means secured to the lower end of the hand cover for protecting the wrist area of the individual from injury when hit on the wrist area with the baseball when batting the baseball;

wherein the hand protector means and the wrist protector means are secured to the hand cover so as not to impede the flexibility of the wrist of the individual when batting the baseball;

the wrist protector means comprises:

a flexible wrist band connected to the lower end of the hand cover; and protector means secured to the wrist band so that the protector means is positioned over the wrist area of the individual when the wrist protector means is secured over the wrist of the individual for protecting the wrist area from injury when hit on the wrist area with the baseball;

the protector means of the wrist protector means comprises:

a base constructed of a rigid material capable of being hit by the baseball when same is traveling at a relatively high velocity without substantially bending or breaking, the base having an upper surface and a lower surface; and pad means connected to the lower surface of the base for absorbing a portion of a shock when the base is hit with the baseball.

9. The wrist protector of claim 8 wherein the base is arc shaped so as to substantially conform to the contour of the wrist area.

10. The protective glove of claim 8 wherein the base is constructed of a metal.

11. The protective glove of claim 8 wherein the wrist protector means further comprises:

a panel connected to the inner surface of the wrist band so as to form a pocket between the panel and the inner surface of the wrist band, the pocket being positioned adjacent the wrist area of the individual when the wrist protector means is secured over the wrist of the individual, the base and the pad means of the wrist protector means being disposed within the pocket.

12. A protective batting glove adapted to be secured about an individual's hand and wrist when batting a baseball to protect a hand area and a wrist area of the individual from injury if hit thereon by the baseball, the protective glove comprising:

a flexible hand cover positionable about the hand of the individual so as to substantially cover the hand, the hand cover having a lower end;

hand protector means for protecting the hand area of the individual from injury when hit on the hand area with the baseball when batting the baseball, the hand protector means secured to the hand cover so that the hand protector means is positioned over the hand area of the individual when the hand cover is disposed about the hand of the individual; and wrist protector means secured to the lower end of the hand cover for protecting the wrist area of the individual from injury when hit on the wrist area with the baseball when batting the baseball;

wherein the hand protector means and the wrist protector means are secured to the hand cover so as not to impede the flexibility of the wrist of the individual when batting the baseball;

the wrist protector means comprises:

a flexible wrist band connected to the lower end of the hand cover; and protector means secured to the wrist band so that the protector means is positioned over the wrist area of the individual when the wrist protector means is secured over the wrist of the individual for protecting the wrist area from injury when hit on the wrist area with the baseball;

the wrist band has an upper end, a lower end, a first side, a second side, an inner surface and an outer surface, wherein the upper end of the wrist band is connected to the lower end of the hand cover, and wherein the wrist protector means further comprises:

fastening means for fastening the first side of the wrist band to the second side of the wrist band so that the wrist band is secured generally over the wrist area of the individual.

* * * * *

UNITED STATES PATENT AND TRADEMARK OFFICE

CERTIFICATE OF CORRECTION

PATENT NO. : 5,604,931

DATED : February 25, 1997

INVENTOR(S) : Rhoades

It is certified that error appears in the above-indentified patent and that said Letters Patent is hereby corrected as shown below:

Column 2, line 2, after "wrist area" delete "is" and substitute therefor --as--.

Column 2, line 31, delete "hand cover 18" and substitute therefor --hand protector 18--.

Column 2, line 32, delete "hand over 16" and substitute therefor --hand cover 16--.

Column 2, line 34, after "hand area 12" insert --so not to impede the--.

Column 2, line 64, before "substantially" insert --so as to--.

Column 2, line 66, after "by" insert --a--.

Column 3, line 20, delete "base cove 20" and substitute therefor --base cover 20--.

Column 3, line 32, before "three" delete "the".

Column 3, line 32, delete "cloth panel 6" and substitute therefor --cloth panel 66--.

UNITED STATES PATENT AND TRADEMARK OFFICE

CERTIFICATE OF CORRECTION

PATENT NO. : 5,604,931

DATED : February 25, 1997

INVENTOR(S) : Rhoades

It is certified that error appears in the above-identified patent and that said Letters Patent is hereby corrected as shown below:

Column 3, line 62, delete "strip 92 and 93" and substitute therefor --strips 92 and 93--.

Column 4, line 5, delete "grasp" and substitute therefor --grasps--.

Column 4, line 8, delete "wrist band 44" and substitute therefor --wrist band 49--.

Column 4, line 9, delete "strip 92 and 93" and substitute therefor --strips 92 and 93--.

Signed and Sealed this

Twelfth Day of August, 1997

Bruce Lehman

*Attest:*

BRUCE LEHMAN

*Attesting Officer*

*Commissioner of Patents and Trademarks*